United States Patent [19]

Klein

[11] Patent Number: 4,491,501

[45] Date of Patent: Jan. 1, 1985

[54] METHOD FOR WASHING A FIBROUS PARTICLE MAT WITH WASH LIQUOR HAVING AN IMPACT ENERGY SUFFICIENT TO DISRUPT AND REARRANGE THE INTERSTITIAL PORE MATRIX

[75] Inventor: Edward P. Klein, Covington, Va.

[73] Assignee: Westvaco Corporation, New York, N.Y.

[21] Appl. No.: 447,960

[22] Filed: Dec. 8, 1982

[51] Int. Cl.[3] ..... D21C 9/02; D21C 9/06

[52] U.S. Cl. ..... 162/60; 8/156; 8/158; 68/205 R; 210/402

[58] Field of Search ..... 162/60, 19, 49, 40; 8/156, 158; 68/181 R, 205 R; 210/404, 406, 407, 402

[56] References Cited

U.S. PATENT DOCUMENTS

| | | | |
|---|---|---|---|
| 3,032,100 | 5/1962 | Schibbye | 162/308 |
| 3,258,391 | 6/1966 | Cornell et al. | 210/406 |
| 3,363,774 | 1/1968 | Luthi | 210/406 |
| 3,403,786 | 10/1968 | Luthi | 210/406 |
| 3,409,139 | 11/1968 | Jackson et al. | 210/406 |
| 3,487,941 | 1/1970 | Haapamaki | 210/404 |
| 4,138,313 | 2/1976 | Hillstrom et al. | 162/60 |
| 4,297,164 | 10/1981 | Lee | 162/60 |

OTHER PUBLICATIONS

Lee, P. F., "Optimizing the Displacement Washing of Pads of Wood Pulp Fibers," Sep., 1979, *TAPPI*, vol. 62, No. 9, p. 75.

Grähs, L. E., "Displacement Washing of Packed Beds of Cellulose Fibres," 1976, *Svensk Papperstidn*, No. 4, p. 123.

Gullichsen, J. and Östman, H., "Sorption and Diffusion Phenomena in Pulp Washing," Jun., 1976, *TAPPI*, vol. 59, No. 7, p. 140.

Rosen, A., "Adsorption of Sodium Ions on Kraft Pulp Fibers During Washing", Sep. 1975, *TAPPI*, vol. 58, No. 9, p. 156.

Norden, H. V., et al., "Statistical Analysis of Pulp Washing on an Industrial Rotary Drum," *Pulp and Paper Magazine of Canada*, Oct., 1972, 74(10):T329.

Perkins, J. K., "How to Improve Kraft Brown Stock Washing Efficiency," Feb. 24, 1969, *Paper Trade Journal*, p. 30.

Kommonen, F., "Pulp Washing Evaluation for Design and Operation," 1968, *Papper och Tra*, No. 6, p. 347.

Pellett, G. L., "Longitudinal Dispersion, Intraparticle Diffusion, . . . Systems," Feb. 1966, *TAPPI*, vol. 49, No. 2, p. 75.

Meyer, H., "A Filtration Theory for Compressible Fibrous Beds Formed from Dilute Suspensions,38 Apr., 1962, *TAPPI*, vol. 45, No. 4, p. 296.

Perkins, J. K., et al., "Brown Stock Washing Efficiency: . . . Determination," Mar., 1954, *TAPPI*, vol. 37, No. 3, p. 83.

*Primary Examiner*—Steve Alvo

*Attorney, Agent, or Firm*—W. A. Marcontell; R. L. Schmalz

[57] ABSTRACT

A method of improving the washing efficiency for removal of cooking and bleaching chemicals from cellulose paper pulp on rotary vacuum filters by disrupting the filter mat with a low volume, directly impinged flow of wash liquor applied intermediately of soft, displacement wash liquor applications. No additional wash liquor is allocated for respective wash stages but the mat disturbing flow volume is deducted from the predetermined requirement with the remainder divided in substantially equal proportions applied before and after the mat disturbing application.

18 Claims, 7 Drawing Figures

METHOD FOR WASHING A FIBROUS PARTICLE MAT WITH WASH LIQUOR HAVING AN IMPACT ENERGY SUFFICIENT TO DISRUPT AND REARRANGE THE INTERSTITIAL PORE MATRIX

BACKGROUND OF THE INVENTION

1. Field of the Invention

The present invention relates to the preparation of cellulose fiber pulp from wood and other cellulosic materials. More particularly, the present invention relates to the flushing or washing of lignin, digestion and bleaching chemicals from cellulosic pulp.

2. Description of the Prior Art

Raw wood, bagasse and other cellulosic fiber sources are delignified by cooking processes in the presence of chemicals which form water soluble compounds and complexes with the natural lignin binder of the raw fiber matrix. Although the chemicals used in the digestive cooking process are relatively inexpensive, those quantities consumed in the 1500 tons of dry pulp per day production of an average pulp mill necessitates an economical recovery and recycle of such chemical values. Moreover, the lignin compounds which must be removed from the cellulose fiber matrix contain sufficient heat value and volatility to contribute favorably to the overall mill heat balance.

The objectives of chemical and heat value recovery from wood cooking liquors are gained simultaneously in a pulp mill recovery furnace. Chemically hydrolyzed lignin, called black liquor, is water flushed from the pulp on a filter surface which permits the liquor and water to drain from the pulp while the fibers are supported and retained on the filter.

As washed from the pulp, black liquor contains approximately 10% to 20% solids in solution and suspension with water. To recover the heat and chemical values present in black liquor, the solids concentration of the solution must be increased to approximately 60%: sufficient to fuel a sustained combustion. This is normally accomplished by evaporation. The 60% solids heavy black liquor is burned in the recovery furnace to release both inorganic chemical values combined therewith and heat to generate steam. A portion of such liquor generated steam is used in a continuous evaporation flow stream for black liquor concentration with the remainder used in support of other mill processes such as paper drying.

This interrelated chemical recovery process is economically dependent on the balance between heat value and water in the black liquor flow stream. Excess water in the liquor stream adds to the heat demand for liquor evaporation thereby reducing the quantity of heat available from lignin fuel to support other mill processes. Such other mill processes must consequently be supported by purchased, supplemental fuels thereby adding dramatically to the over-all mill energy costs.

The usual source of such excess liquor water is at the pulp washers, the first objective of most pulp mills being a clean pulp. Excess lignin remaining in the pulp beyond the washers adds to the bleaching chemical costs or finally, in unacceptable paper quality.

From the foregoing, it should be appreciated that pulp washing efficiency is pivotal to the favorable economics of a pulp mill.

The current, customary practice of pulp washing includes the use of two to seven rotary drum vacuum filters such as described by U.S. Pat. Nos. 3,363,744; 3,403,786; 3,409,139 and 4,138,313. Pursuant to this practice, a slowly rotating drum filter is partially submerged in a mixing vat containing a 1% to 3% consistency slurry of pulp. A partially evacuated drum interior draws the slurry against the submerged, filter screen surface of the drum. Pulp fibers are retained on the screen surface while a portion of the water contained in the pulp passes therethrough. Such fiber accumulation on the drum screen surface builds a fiber mat thereon until drum rotation carries the mat above the mixing vat slurry surface. In an arcuate increment between emergence from the vat surface and reentry into the respective wash stage vat, the mat is peeled from the drum surface and directed into the vat of the subsequent wash stage where the process is repeated.

As the pulp washing sequence advances from the first to last stage, filtrate drawn from the pulp advances counterflow of the pulp so that the filtrate of each stage is used to wash the preceding stage pulp mat.

In theory, plug flow displacement of mat liquor with more dilute wash liquor provides the least mixing of the respective liquors and the greatest wash efficiency. If ideal plug flow was attainable in all stages, no more fresh water would be added to the last wash stage than is discharged with the pulp from the last stage. Unfortunately, the ideal is not attainable in practice due to the fact that the filter surface mat is neither homogeneously permeable nor porous. Mat liquor contained within the interstitial matrix between the fibers is not uniformly available to wash liquor displacement. Accordingly, the available wash liquor passes through the mat along a dispersed system of channels and interconnected large pores. These channels and interconnected large pores are flushed of mat liquor but large volumes of mat liquor trapped in closed or restricted pores remains to be carried over into the next wash stage.

An objective of the present invention therefore is to provide a method and apparatus for improving the washing efficiency of pulp on drum filters over that previously attainable by the prior art.

Another object of the present invention is to improve the washing efficiency of an entire series of pulp washers by improving the efficiency of each washer stage within the series.

Another object of the present invention is to increase the percentage of interstitial mat liquor present in a filter mat that is available to wash liquor displacement.

Another object of the present invention is to teach a wash liquor application sequence that removes a greater percentage of interstitial liquor present in a filter mat with no more than a prior art quantity of wash liquor.

SUMMARY OF THE INVENTION

These and other objects of the invention are accomplished by a shower sequence wherein a small portion of the wash liquor allocated for a given wash stage is applied in such a manner as to disrupt the pulp mat previously established on the filter surface.

As the pulp mat emerges from the mixing vat attached to the perforated filter surface of the rotating drum, wash liquor is gently applied to the mat surface in several stages distributed over an arcuate increment of the drum rotational path. Between adjacent gentle application stages, however, a low volume, high pressure quantity of wash liquor is directed into the mat to disrupt and rearrange the mat pore matrix thereby opening previously closed pores and displacement channels.

BRIEF DESCRIPTION OF THE DRAWING

Relative to the drawings wherein like reference characters designate like or similar elements throughout the several figures of the drawings.

DESCRIPTION OF THE PREFERRED EMBODIMENT

Figure 1:
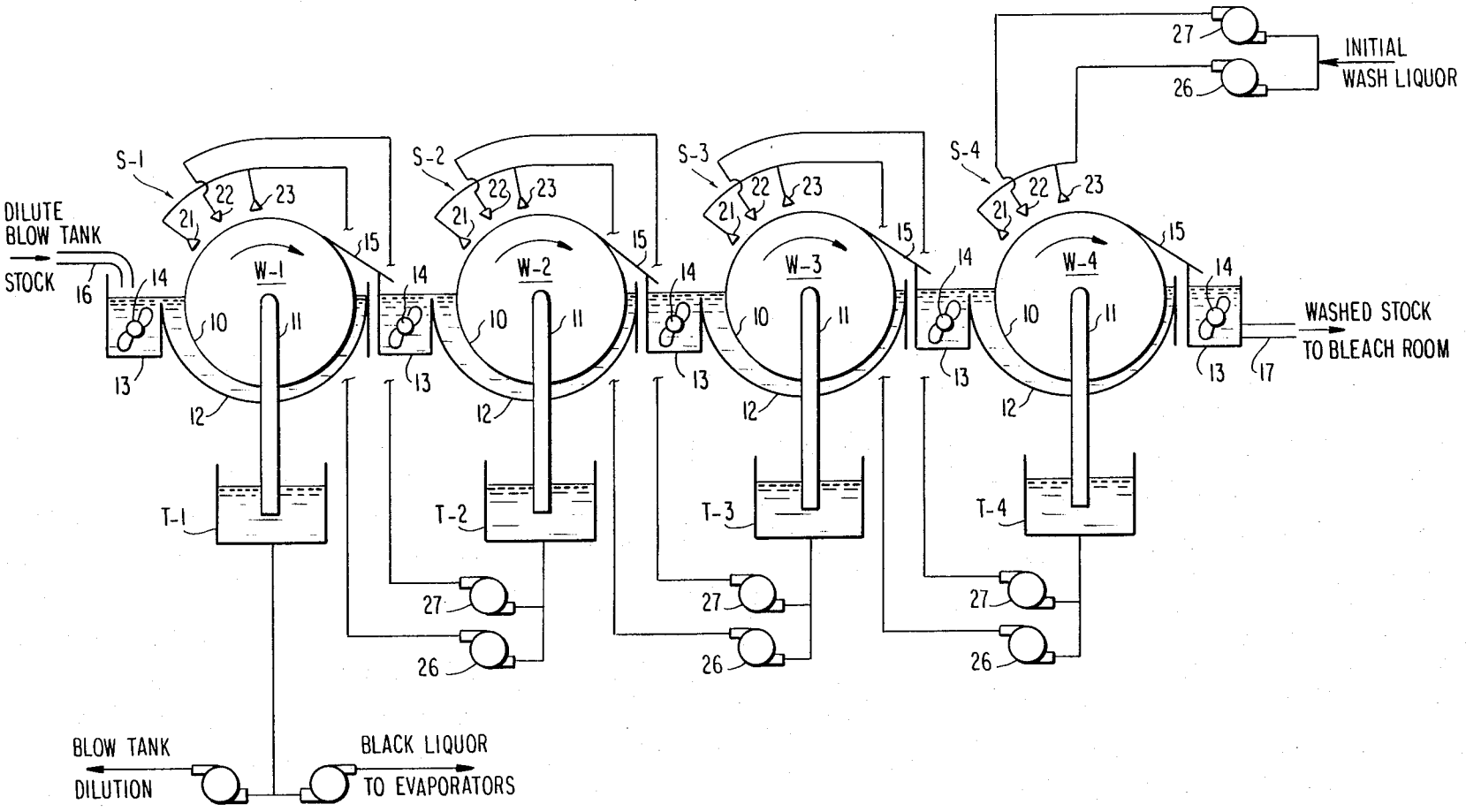
FIG. 1 illustrates a flow schematic of a four stage, brown stock pulp washing plant.

A representative pulp washing system is schematically illustrated by FIG. 1 to include four washing stages W-1, W-2, W-3 and W-4. Each wash stage includes a rotatively driven filter drum 10 having a perforated screen surface around the circumferential periphery thereof and an evacuated interior. Conduits 11 represent vacuum drop-legs for withdrawal of liquor from the drum 10 interiors for deposit into filtrate tanks T-1, T-2, T-3 and T-4, respectively.

Each filter drum 10 is partially immersed in a mixing vat 12 that is supplied with slurried pulp from a respective repulper 13 having an agitation means 14.

Dewatered pulp mat is scraped from the filter surface of each drum 10 by a doctor board 15 for transfer to the repulper 13 respective to the next successive wash stage.

A blow tank stock supply conduit 16 delivers freshly digested pulp to the first wash stage repulper 13, usually from a deknotting apparatus which removes undigested knots of fiber. From the final wash stage W-4, an additional repulper 13 is provided to reslurry the mat in preparation for transfer through conduit 17 to the next process stage which usually is the bleaching operation.

Disposed above the filter surface of each washer drum 10 in the upper ascedent quarter thereof relative to the rotational direction are shower sources S-1, S-2, S-3, and S-4 for wash liquor be deposited onto the pulp mat attached to the drum filter surface.

Wash liquor supply for each of the wash liquor shower sources is drawn from the succeeding wash stage filtrate. To this end, pumps 26 and 27 draw liquor from the final stage filtrate tank T-4 for deposit on the drum mat of third wash stage W-3.

Initial wash liquor for the final stage W-4 normally is derived from low liquor or liquor-free process water sources such as evaporator condensate. Filtrate from the first wash stage tank T-1 is pumped to the black liquor evaporators for further solids concentration by means of evaporative processes.

Wash liquor application in the general case of the invention will include, for example, a gentle, non mat disruptive flow from liquor pump 26 of approximately ninety percent of the total wash liquor allocated for a respective wash stage divided evenly through each of the first and third showers 21 and 23, respectively.

The remainder of the total wash liquor allocation for a given wash stage, approximately 10 percent, is directed by pump 27 through the second shower 22. Discharge from the second shower 22 is carefully regulated to disrupt the pulp mat without a "breakthrough" disturbance. A breakthrough disturbance would be one to dislodge the mat from the filter screen.

The FIG. 1 schematic illustrates two filtrate pumps 26 and 27 to emphasize the distinction between flow rates and delivery pressures respective to the discharges from the first and third showers 21, 23 and the intermediate, second shower 22. More will be developed on these distinctions subsequently. However, that embodiment of the invention represented by FIG. 2 illustrates that in many applied cases of the invention, an actual pumped differential is not required to accomplish the desired objective.

Figure 2:
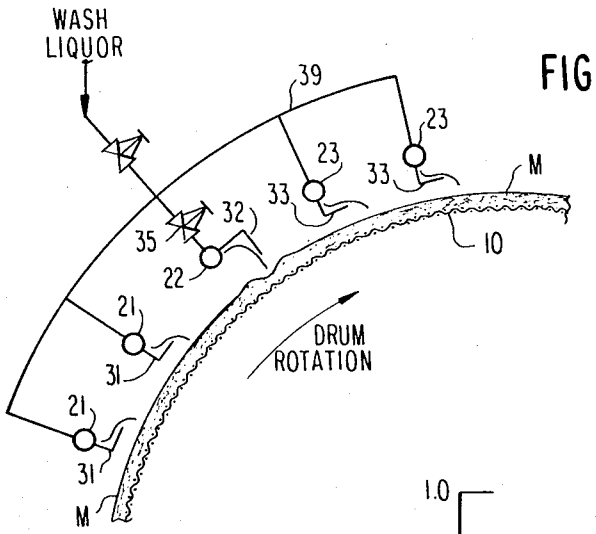
FIG. 2 shows a particular shower and corresponding plumbing embodiment of the invention.

In FIG. 2, the first and third showers 21, 23 are shown as double row wash liquor sources from which the liquor is discharged against diffusion baffles 31 and 33 so as to fall upon the drum 10 attached mat M as gently as possible.

Flow from the second shower 22, however is rate regulated by the valve 35 and directed by baffle 32 directly into the mat M for maximum impact. To be noted from the FIG. 2 embodiment is that all showers 21, 22 and 23 are supplied from the same manifold source 39. Consequently, both, the mat flushing showers 21 and 23 and the mat disturbing shower 22 are charged from a common pressure point. This circumstance merely emphasizes the small energy differential that may be required, depending on the mat M thickness, to effect a non mat disturbing, flush flow of wash liquor as opposed to a mat disturbing flow that rearranges the intersitial flow channels within the mat.

Heretofore described has been the procedural and apparatus essence of the invention. To describe the effectiveness of the invention, it is necessary to develop definitions of mat washing parameters for comparison.

The fraction of mat liquor removed on a vacuum filter is expressed as the Displacement Ratio (DR). This expression was developed by Perkins, Welsh and Mappus and published in the organ of the Technical Association of Pulp and Paper Industries, TAPPI, 37 (3): 83 (1954).

Definitively, the DR is the achieved reduction in dissolved solids (black liquor) concentration on a vacuum filter divided by the maximum possible reduction in dissolved solids concentration.

$$DR=(C_o-C_D)/(C_o-C_s)$$

where $C_o$=concentration of dissolved solids in vacuum filter mixing vat, # dissolved solids/# liquor $C_D$=concentration of dissolved solids in the liquor discharged with the pulp, # dissolved solids/# liquor $C_s$=concentration of dissolved solids in the shower liquor, # dissolved solids/# liquor.

A maximum DR equal to 1.0 would be achieved if all the original liquor held within the intersticies of a vacuum filter mat was displaced by shower liquor. In that case, $C_D$ would equal $C_s$.

In the publication of *Pulp and Paper Magazine of Canada*, 74(10): T329 (1973) H. V. Norden et al described wash liquor consumption as the Wash Liquor Ratio ($\theta$). $\theta$ was defined as the quantity of wash liquor divided by the quantity of liquor discharged with the pulp.

$$\theta = W_s/W_D$$

where:

$W_s$=wash liquor flow rate, # liquor/min.

$W_D$=quantity of liquor discharged with the pulp, # liquor/min.

Typical Wash Liquor Ratios in the paper pulp industry range from 1 to 2 for brown stock washing and often less for bleach room washing.

An ideal displacement of mat liquor by wash liquor would occur if the wash liquor advanced in a plane through the mat in uniform plug flow expelling the mat liquor before it as filtrate. Consequently, if the plug flow of wash liquor displaced all the initially present mat liquor (DR=1.0) when the volume of wash liquor applied, $W_s$, equals the volume of residual liquor discharged with the pulp, $W_D$, ($\theta$=1.0), an ideal case of displacement washing would result.

Unfortunately, even under the best of conditions and equipment, ideal displacement washing cannot be achieved due to the sorption of dissolved substances, dispersion in the direction of flow and slow diffusion of liquor from the fiber lumen and stagnant regions between the fibers. In other words, interstial characteristics of the mat (i.e., mat formation) bears a strong influence on the efficiency of displacement washing actually achieved.

Poor mat formation is characterized as a collection of pores widely differing in radii and length. Intuitively, wash liquor flows more readily through large diameter, short pores leaving initially present mat liquor behind in small diameter, long pores. Accordingly, washing efficiency is reduced by a mat having a wide mixture of pore sizes due to preferential flow of the wash liquor through the large radius pores: an observation noted by P. F. Lee in U.S. Pat. No. 4,297,164.

To objectively define mat formation quality, a Formation Index (FI) has been developed based on the following assumptions. First, all pores are of equal length. Second, all pores have a radius between $(1-\alpha)$ $R_o$ and $(1+\alpha)$ $R_o$ where $R_o$ is the average pore radius and $0<\alpha<1.0$. Finally, there is an equal volume of pores at each radius in the range of radii defined by $\alpha$. Hence, $FI=1-\alpha$.

From the relationship $FI=1-\alpha$, it will be noted that a uniform distribution of pore sizes (i.e., $\alpha=0$) gives FI=1.0. A low Formation Index indicates a wide distribution of radii and a poor quality of mat formation from the standpoint of washing efficiency. The foregoing relationships of Formation Index, Wash Liquor Ratio and Displacement Ratios may be combined in the simplified special case of final wash stage where the influent shower liquor $C_s$ is fresh water containing no dissolved solids and the Displacement Ratio would reduce to $DR=1-C_D/C_o$. Such special case relationship provides the useful analytical model of a washer wherein:

$$\frac{C_D}{C_o} = \frac{(3+\alpha^2)^{0.5}}{4.90\alpha\theta^{0.5}} - \frac{(3+\alpha^2)^{0.5}}{29.4\alpha\theta^{0.5}} - \frac{(1-\alpha)}{2\alpha} + \frac{(1-\alpha)^3\theta}{2\alpha(3+\alpha^2)} - \frac{(3+\alpha^2)}{24(1+\alpha)\theta\alpha} + \frac{(3+\alpha^2)^{0.5}\,0.102}{\alpha\theta^{0.5}}$$

Figure 3:
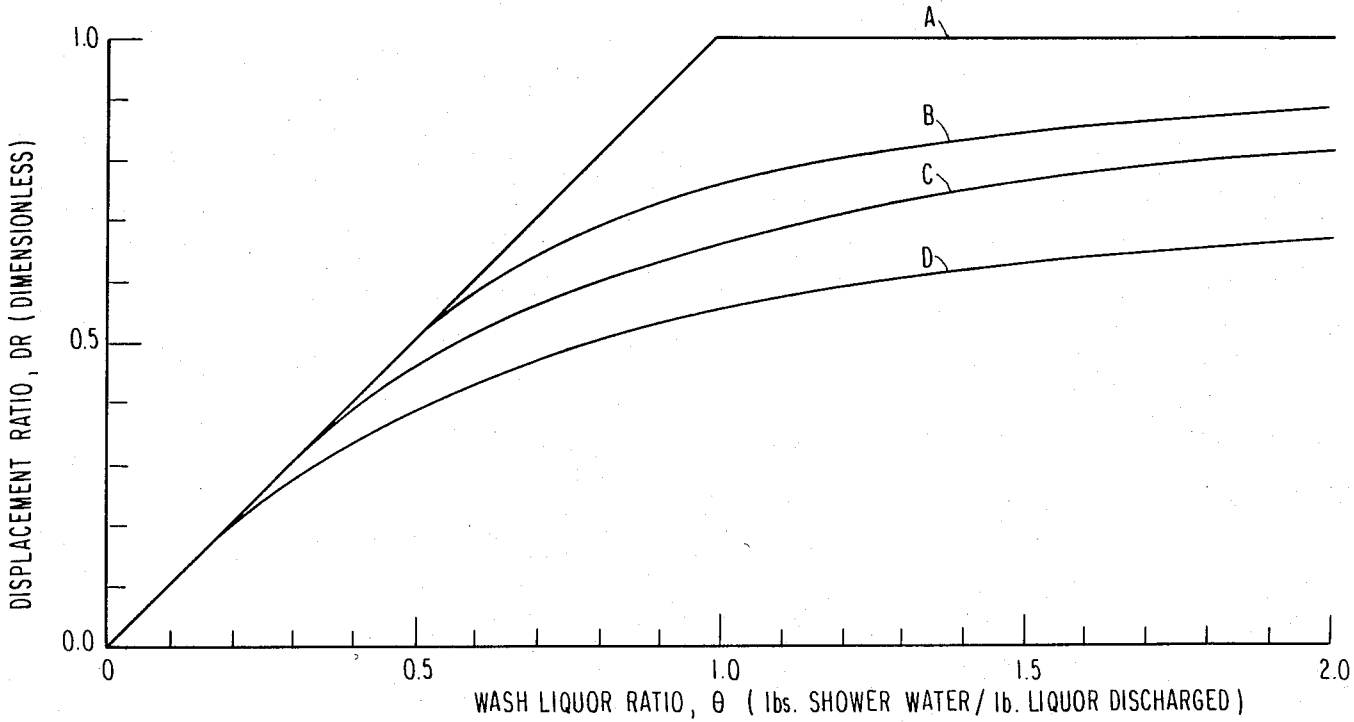
FIG. 3 graphically charts the Displacement Ratio vs Wash Liquor Ratio characteristics of an analytical model by which the present invention is evaluated.

FIG. 3 graphically represents this analytical model wherein curve A describes the ideal plug flow condition and curve B describes the Displacement Ratio vs Wash Liquor Ratio for a mat having a Formation Index of 1.0. Curve C describes the DR vs $\theta$ relationship for a mat having an FI=0.5 and curve D the same relationship for a mat having an FI=0.5.

To further demonstrate the effect formation quality, as defined by the Formation Index, has on washing efficiency, the foregoing analytical model will show that a mat having FI=1.0 flushed with a Wash Liquor Ratio of 2.0 will provide a Displacement Ratio of 0.875. However, if the FI=0.05, the DR=0.670. Based on pulp feed and discharge consistencies of 14% and vat consistencies of 2% in each case, the washing yield (1% recovery of solid material in feed) in a single stage is 93.3% for a FI=1.0 and 83.3% for a FI=0.05. Thus, mat formation quality plays a crucial role in washing efficiency.

Figure 4:
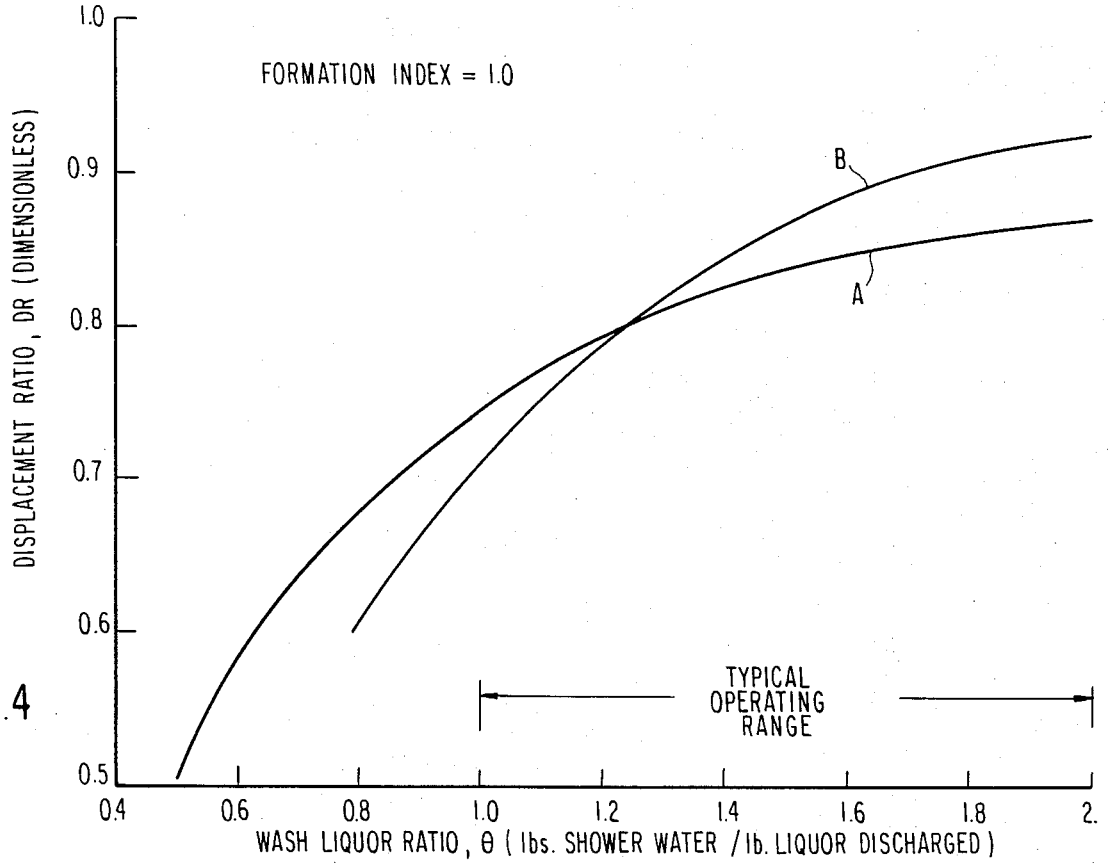
FIG. 4 represents an analytical comparison of Displacement Ratio and Wash Liquor Ratio relationships respective to prior art displacement washing and the present invention procedure for a filter mat having a Formation Index of 1.0.
Figure 5:
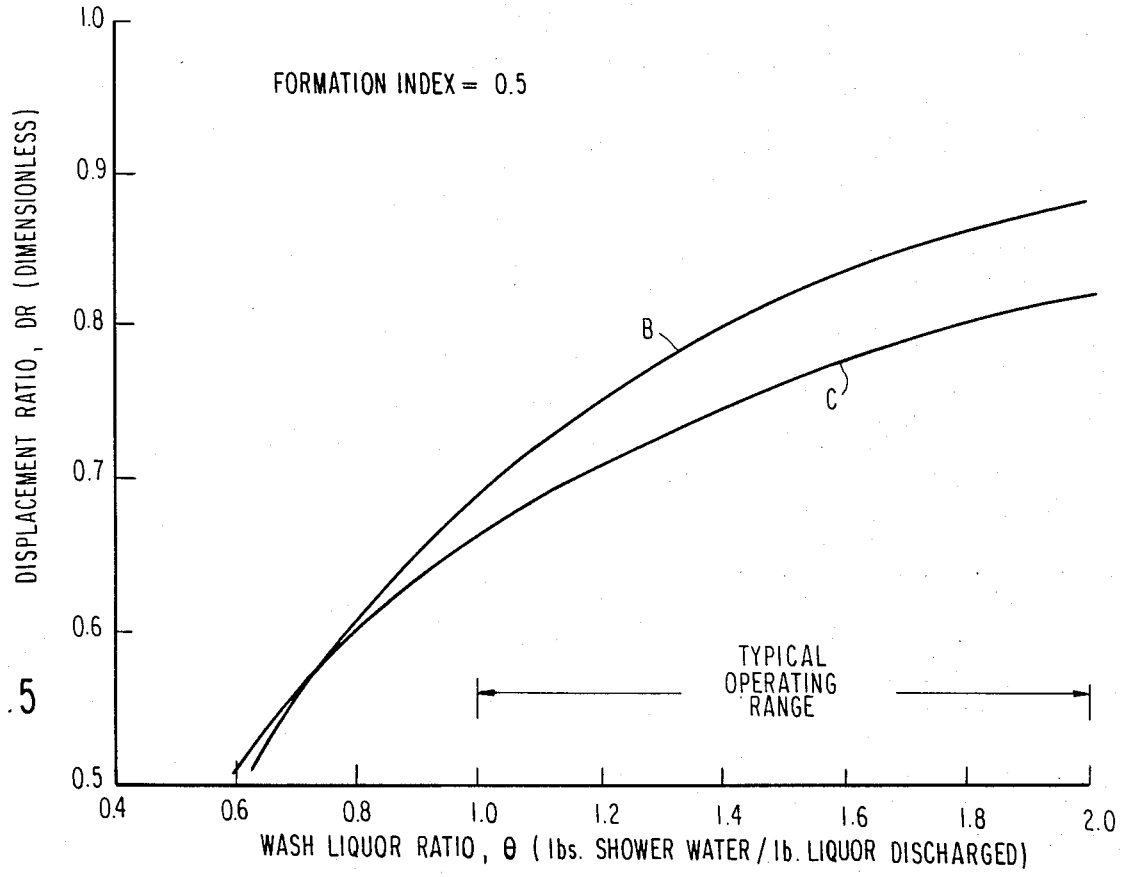
FIG. 5 represents an analytical comparison of Displacement Ratio and Wash Liquor Ratio relationships respective to prior art displacement washing and the present invention procedure for a filter mat having a Formation Index of 0.50.
Figure 6:
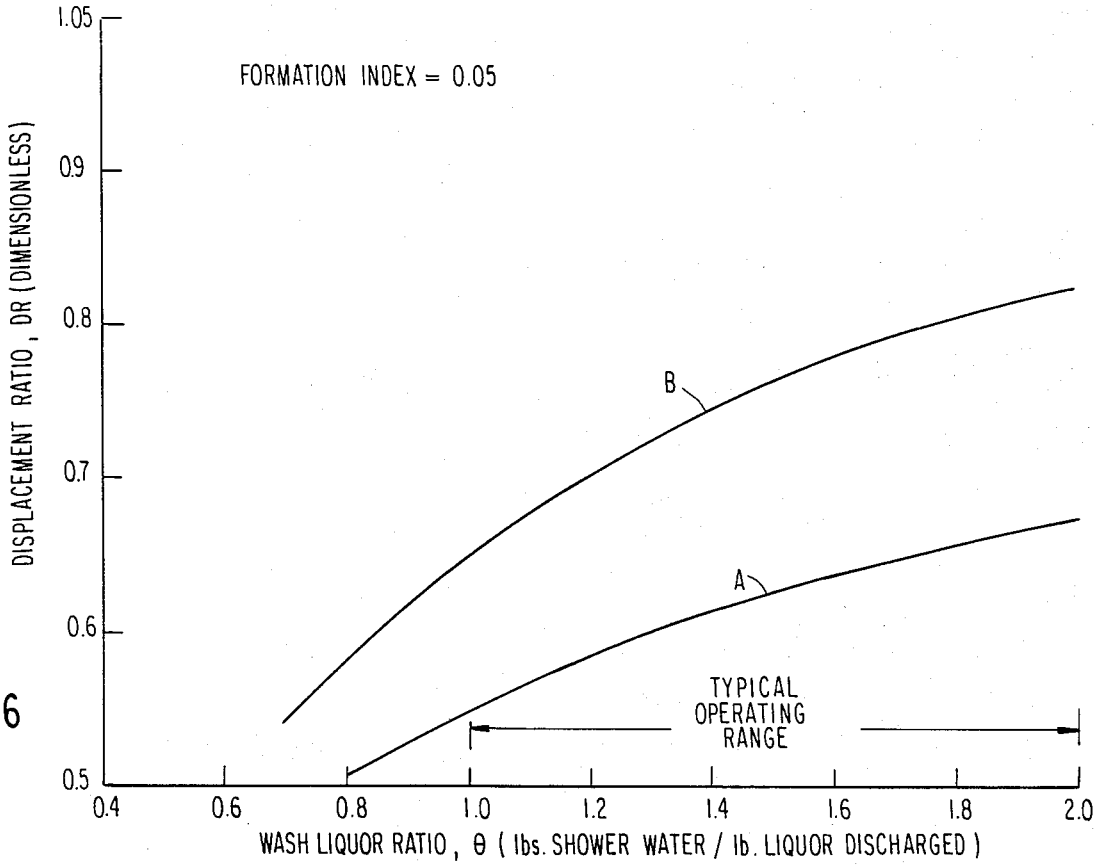
FIG. 6 represents an analytical comparison of Displacement Ratio and Wash Liquor Ratio relationships respective to prior art displacement washing and the present invention procedure for a filter mat having a Formation Index of 0.050.

Using the perceptions of FIG. 3 and the analytical washing model, FIGS. 4–6 effectively illustrate the operational advantages of the present invention as compared to the prior art washing technique of applying all of the wash liquor only in the soft, displacement mode. According to the present invention, a small percentage of the total wash liquor allocated to a respective wash stage, one sixth for example, is dedicated to a non-breakthrough disruption of the filter mat. The remainder of the wash liquor is applied in equal proportions before and after the mat disruptive application.

FIG. 4 illustrates the DR vs $\theta$ consequences of washing an excellent quality filter mat having a FI=1.0 by the prior art technique of displacement washing only, curve A, as compared to the displacement, disruption, displacement technique of the invention, curve B. Of particular note from the FIG. 4 representation is the break-even point at a DR of 0.81 and a $\theta$ of 1.24. Below this break-even point, a washing condition signified by low wash liquor flow rates, the invention may have no advantage over conventional displacement washing. Moreover, due to the positively induced wash liquor/mat liquor mixing in the mat disruptive step, the present invention may even be reverse productive.

It is in the more operationally dominant circumstance of a moderately well formed mat having a FI=0.50 that the present invention proves its worth as illustrated by the comparison of prior art curve A to the invention curve B of FIG. 5. As the DR and wash liquor flow rate increases, the invention procedure of intermediate mat disruption increasingly improves the washing efficiency.

Finally, FIG. 6 represents the production circumstances of heavily loaded washers having a thick, poorly formed filter mat with a FI=0.05. Under this circumstance, there is no break-even point and the invention procedure of curve B provides a better wash result than the prior art procedure of curve A at all wash liquor flow rates.

Figure 7:
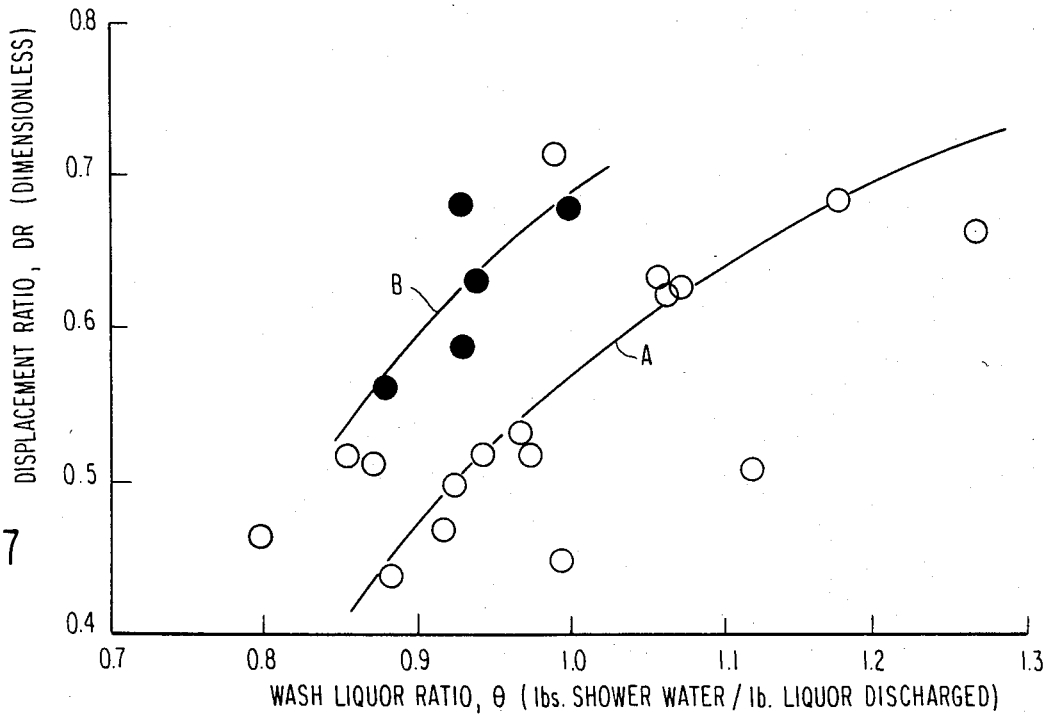
FIG. 7 represents a comparison of actual Displacement Ratio and Wash Liquor Ratio data taken from a production line pulp washing filter respective to prior art displacement washing and the present invention.

FIG. 7 represents data taken from comparative trials made on a 11.5 ft.×16 ft. rotary vacuum filter used for washing 600 tons of paper pulp per day. Curve A shows the average of data points taken while washing in the prior art displacement only mode. Subsequently, an intermediate line of displacement showers were modified so as to apply a small quantity of the wash liquor in a manner that was mildly disruptive of the filter mat. Curve B shows the average of data points (shaded) taken in the displacement, disruption, displacement mode of the invention.

A negative consequence of the tests from which the FIG. 7 data is drawn was that the pulp discharge consistencies dropped from an average of 14.8% to 13.8% with the use of the invention. Nevertheless, by increasing the Displacement Ratio from an average of about 0.50 to a range of 0.55 to 0.65 with the invention; a net gain of washing efficiency is obtained.

Although the present invention has been described in the context of brown stock washing, it should be understood that the principles embodied hereby may be applied as well to bleach room washing wherein stock bleaching chemicals are flushed from the pulp by water or neutralizing chemicals. Similarly, the principles should be applicable to any vacuum filter mat of a porous fiber constituency.

To emphasize the point that only minimal quantities of wash liquor should be used in the practice of the invention, an allocated portion of the total wash liquor for a given stage may range from 10% to 20% in those applications such as FIG. 2 where both, displacement flow and disturbance flow is derived from the same pressure source. However, use of a booster pump to increase the available mat impact energy from the disturbance flow showers such as shown by FIG. 1 may decrease the requisite flow volume to a quantity of only about 10%.

The preferred embodiment of my invention has been described in the context of vacuum drum filters but the utility and application thereof to pressure filters is equally relevant. In either case, the filter mat is developed and drained under a pressure differential.

As a caveat to brown stock washing, use of the invention on the first wash stage should be carefully evaluated. In that application, the stock arrives at the repulper 13 in a well dispersed suspension due to previous screening and pumping. Consequently, the mat developed on the first stage drum screen has a high probability of being of excellent quality. From the representations of FIG. 4, it was seen that the washer throughput must also be high to exceed the efficiency of conventional displacement washing of a high quality mat. Moreover, some black liquors are, in the high solids concentrations of the first stage washer, extremely sensitive to foaming. In such cases, the possible consequences of foaming induced by the mat disturbance step may also mitigate against any efficiency advantages offered by the invention.

With the foregoing caveats in mind, the present invention offers the potential for considerable savings in recovery energy costs where the wash equipment and production rates result in high Wash Liquor Ratio and/or poor (i.e., thick and lumpy) filter mat formations.

Having fully described by invention, I claim:

1. A method of flushing suspension liquor from a liquid slurry including fibrous particles suspended in said liquor comprising the steps of:

A. pressure differentially drawing said slurry against a filter screen for separating said particles from said liquor by passing said liquor through said screen which retains said particles deposited thereon in a fibrous mat accumulation having a porous matrix of interstitial flow channels formed therein:

B. removing said screen from said slurry with said mat deposited thereon and said flow channels saturated with said liquor;

C. first flushing said liquor from said mat flow channels with a first quantity of wash liquor applied gently and substantially uniformly to the surface of said mat without substantial disturbance of the interstitial pore matrix within said mat;

D. following said first flushing, applying a second quantity of wash liquor with direct impingement into said mat with sufficient impact energy as to disrupt and rearrange the interstitial pore matrix of flow channels within said mat thereby opening previously closed pores and flow channels without dislodging said mat from said filter screen; and, E. following said direct impingement, second flushing said mat with a third quantity of wash liquor applied gently and substantially uniformly to the surface of said mat without substantial disturbance of said rearranged interstitial pore matrix of flow channels therewithin, said second quantity of wash liquor being less than 20 percent of the total of said three quantities of wash liquor.

2. A method as described by claim 1 wherein said suspension liquor comprises lignin and wood pulp digestion chemicals and said wash liquor comprises less concentrated solutions of lignin and digestion chemicals.

3. A method as described by claim 1 wherein said suspension liquor comprises wood pulp bleaching chemicals and said wash liquor comprises bleaching chemical solutions of less concentration than said suspension liquor.

4. A method as described by claim 1 wherein said screen rotates in a circular path including an arcuate segment of slurry immersion.

5. A method as described by claim 4 wherein said pressure differential is induced by drawing a partial vacuum internally of said circular screen path.

6. A method as described by claim 1 wherein said second quantity of wash liquor is from 10 percent to 20 percent of the sum of the three quantities.

7. A method as described by claim 6 wherein said three quantities of wash liquor are extracted from the same pressure source.

8. A method as described by claim 1 wherein said second quantity of wash liquor is no more than 10 percent of the sum of the three quantities.

9. A method as described by claim 8 wherein said second quantity of wash liquor is extracted from a source of greater pressure than said first and third quantities.

10. A method of washing process liquor from cellulose fiber comprising the steps of:

A. accumulating a mat of said fiber on the surface of a moving screen from a liquor suspended slurry of said fiber with a pressure differential applied across said screen;

B. removing said screen from said slurry with said mat deposited thereon, said mat comprising a first interstitial pore matrix of flow channels formed therewithin by said fiber, said flow channels being saturated with said suspension liquor upon removal from said slurry;

C. with minimal disturbance of said interstitial pore matrix, applying a first quantity of wash liquor to the surface of said mat for substantial displacement of said wash liquor from said flow channels;

D. following said first quantity application of wash liquor, directly impinging a second quantity of wash liquor against the surface of said mat with sufficient impact energy to disrupt and rearrange said first interstitial pore matrix of flow channels into a second flow channel matrix thereby opening previously closed pores and flow channels but without displacement of said mat from said screen; and, E. following said second quantity application, applying a third quantity of wash liquor to said mat with minimal disturbance of said second flow channel matrix, said first and third quantities of wash liquor being substantially equal and the second quantity being no more than 20 percent of the sum of the three quantities.

11. A method as described by claim 10 wherein said process liquor comprises lignin and wood pulp digestion chemicals and said wash liquor comprises less concentrated solutions of lignin and digestion chemicals.

12. A method as described by claim 10 wherein said process liquor comprises wood pulp bleaching chemicals and said wash liquor comprises bleaching chemical solutions of less concentration than said process liquor.

13. A method as described by claim 10 wherein said screen rotates in a circular path including an arcuate segment of slurry immersion.

14. A method as described by claim 13 wherein said pressure differential is induced by drawing a partial vacuum internally of said circular screen path.

15. A method as described by claim 10 wherein said second quantity of wash liquor is from 10 percent to 20 percent of the sum of the three quantities.

16. A method as described by claim 15 wherein said three quantities of liquor are extracted from the same pressure source.

17. A method as described by claim 10 wherein said second quantity of wash liquor is no more than 10 percent of the sum of the three quantities.

18. A method as described by claim 17 wherein said second quantity of wash liquor is extracted from a source of greater pressure than said first and third quantities.

* * * * *